United States Patent [19]

Bevan

[11] Patent Number: 4,524,039

[45] Date of Patent: Jun. 18, 1985

[54] MOULDING OF CONSTRUCTION PRODUCTS

[75] Inventor: Christopher G. Bevan, London, England

[73] Assignee: C. G. Bevan Associates Limited, London, England

[21] Appl. No.: 419,133

[22] Filed: Sep. 17, 1982

Related U.S. Application Data

[63] Continuation of Ser. No. 212,707, Nov. 5, 1980, abandoned.

[30] Foreign Application Priority Data

Mar. 5, 1979 [GB] United Kingdom ..... 7907611

[51] Int. Cl.[3] ..... B06B 3/00

[52] U.S. Cl. ..... 264/71; 264/123; 264/333

[58] Field of Search ..... 264/123, 333, 71

[56] References Cited

U.S. PATENT DOCUMENTS 1,427,103 8/1922 Haenicke ..... 264/123

FOREIGN PATENT DOCUMENTS 1417001 12/1975 United Kingdom .

*Primary Examiner*—John A. Parrish

*Attorney, Agent, or Firm*—Fisher, Christen & Sabol

[57] ABSTRACT

A method of manufacturing construction products which involves feeding dry or substantially dry constituents including a liquid-setting powder and a reinforcement therefor into a molding zone. At least a part of the mold is vibrated to effect compacting of the constituents in the molding zone to such a degree that the constituents will stand and be self-sustaining upon removal of an upstanding portion of the mold. At least a portion of the mold is removed from contact from the compacted constituents, thereby exposing at least one upstanding surface of of the compacted constituents. A quantity of setting liquid is applied to substantially the full extent of the surface. The quantity of setting liquid is sufficient to wet all of the compacted constituents in the molding zone so as to initiate a chemical setting reaction but not sufficient to completely saturate the compacted constituents and to cause the associated effect of structural collapse of the compacted constituents in the region of the exposed surface.

17 Claims, 6 Drawing Figures

MOULDING OF CONSTRUCTION PRODUCTS

This is a continuation of application Ser. No. 212,707, filed Nov. 5, 1980 now abandoned.

TECHNICAL FIELD OF THE INVENTION

This invention relates to the manufacture of construction products and in particular of hollow cored construction products such as partition panels, roof decking, and pipes.

DISCLOSURE OF THE INVENTION

The invention provides a method of manufacturing construction products comprising the steps of feeding dry or substantially dry constituents including a liquid setting powder and a reinforcement therefor into a moulding zone, compacting the constituents in such zone, exposing at least one upstanding surface of the compacted constituents and applying to that surface a predetermined quantity of setting liquid, being a quantity sufficient to wet all of the compacted constituents in the moulding zone but insufficient completely to saturate the same.

The invention also provides a construction product manufactured by the method aforesaid.

In a preferred form the method consists of comppacting dry liquid setting powders,, such as Portland cement, gypsum hemi-hydrate and fillers and reinforcement, such as polypropylene or steel mesh, glass or wood fibers, into a moulding zone containing at least one vertically disposed bore former which may be tapered or bell-mouthed, withdrawing the former(s) and applying limited qantities of setting liquid to the powder surface of the bore(s) during or after withdrawal of the bore former(s). The method is a development of the method described in British Patent Specification No. 1,346,767 in which after the withdrawal of the bore former(s) the mix is saturated by total immersion in water and only removed from the mold after significant setting has taken place—i.e., sufficient water is provided to completely fill the interstices between particles and substantially complete the chemical reaction. The tencancy to subside before setting is restrained by the buoyancy effect from the immersion and by the water in the bore(s) supporting the water in the interstices of the powder.

In British Patent Nos. 1,067,671 and 363,873 there is described a process in which construction products are manufactured by the application of just sufficient water to a dry mix of cause setting of the mix, i.e. to wet, but not to saturate the same. The mold is immersed in water or water is injected under pressure, but the water is allowed access to the mix only through perforations in the walls of the mold and seepage by capillary action enables the water to reach the whole of the mix. During these wetting processes the vertical surfaces of the molded mix are supported by the mold walls.

Surprisingly it has been found that by means of the present invention water may be introduced into a dry mix through unsupported vertical surfaces without either collapse or erosion of those surfaces, In the new method, after withdrawing the bore former(s) only just sufficient liquid is applied to substantially the whole of the unsupported vertical surface(s) of the bore(s) to wet, but not saturate as in the No. 1,346,767 method, the powder/ fiber mix by, for example, lightly spraying the powder surfaces of the bore(s).

Despite the increase in weight from wetting the powder, if the procedures described hereafter are followed, the material does not collapse notwithstanding the absence of the bore formers; nor are the powdery surfaces of the bores eroded or pitted during the wetting action. Provided sufficiently well compacted dry constituents containing sufficient fine particles are dampened with little or no more liquid than that needed to just wet all of the material, the moulding can be sufficiently cohesive to be removed from the mould without waiting for the chemical reaction of hardening to commence. This is not possible with the method in British Patent No. 1,346,767, in which the saturated mixture has the consistency of a thixotropic mud which tends to stick to the mould surfaces and is not self-supporting until chemical hardening is sufficiently far advanced. With the new method the material has the consistency of a damp stiff sandy clay and can come away from the mould quite readily. Demoulding strength is substantially further increased if a significant proportion of fibres is included in the mix and large fibrous mouldings can be handled by conventional means immediately after wetting.

The advantage of early demoulding is that the number of moulds needed for mass production can be dramatically reduced, particularly with slow setting materials such as Portland cement. Even with quick setting materials (such as gypsum) there are advantages, as the setting liquid can be applied rapidly over the entire bore surface by, for example, vertically oscillating spray tubes, whereas in British patent No. 1,346,767 the liquid can only rise sequentially and very gradually in the bores. Another advantage with the new method, particularly in respect to gypsum products, is that only just enough liquid need be applied to complete the chemical reaction of hardening so as to dispense with or significantly reduce the drying processes needed to drive off excess liquid in the earlier saturation method.

Immediate demoulding of dampened, compressed granular/powder material is well-known in concrete block-making, but here the constituents are dampened entering the moulds and do not contain reinforcement. These "earth damp" mixtures used in block-making by virtue of their dampness, are much less free-flowing than the substantially dry materials used in the new process and are much less easy to compact into confined spaces. The resulting moulding consequentially can have nowhere near the intricacy of shape or handling strength achievable by the new method. Furthermore, particle flow becomes particularly difficult or even impossible if structurally significant proportions of tensile reinforcement are added to the damp materials used in block-making, and hence the exceptionally high early demoulding strengths resulting from such reinforcement are not available to conventional methods. In particular, when mixtures containing fibrous reinforcement are processed conventionally substantial extra quantities of liquid are added to make the mix fluid enough for moulding and the excess liquid is then extracted by pressing or suction. This generally limits such processes to simple flat sections. More complex sections of fibrous mixtures can be extruded but generally mixes containing only short fibers can be processed in this way. No conventional process can achieve the unusual combination of features characteristic of the new method where, for example, complex sections such as those shown in FIGS. 1, 2 and 4 can be manufactured with structurally significant proportions of long fibers (e.g. 100 mm) feeding into gaps between bore formers and mould sides of as little as 2 mm, while also achieving high enough strengths immediately after wetting to enable 3000 mm long sections to be demoulded without relying on chemical setting.

BEST MODE OF CARRYING OUT THE INVENTION

Figure 3:
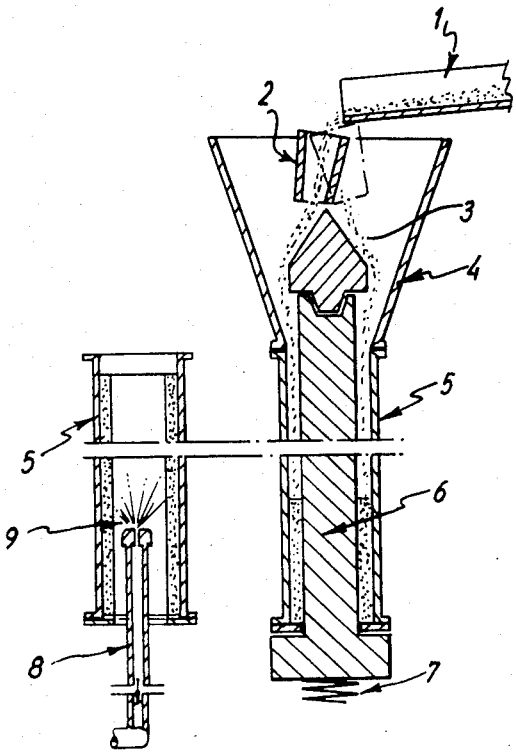
FIG. 3 is a diagrammatic elevation of one form of apparatus suitable for use in practicing the invention.

One of the simplest types of equipment using the new method is shown in FIG. 3. A vibrating tray 1 distributes the dry powder fiber mix into a laterally oscillating chute 2 so that two equal streams of material pass either side of a bore former support 3 and are guided by a hopper 4 into a mould 5, containing bore formers 6 which are fitted at their base with vibrators 7. While filling the mould, the bore formers, preferably together with the hopper bore former support, are vibrated to settle and thoroughly compact the mixture. After filling the mould, the upper parts of the mixture which are not compacted by a head of material above them, are further consolidated by pressing the bore former support 3 (preferably together with the bore formers 6) onto the powder/fiber surface until the whole mass is uniformly compacted. Vibration then ceases and the bore formers and bore former support are withdrawn from the mould, which then moves laterally to locate over spray tubes 8. These tubes are fitted at their ends with fine spray nozzles 9, which are oscillated vertically in the bores until sufficient liquid has been delivered to the powder/fiber bore surfaces to just wet the mixture throughout.

Sprays need to be fine and of modest velocity to avoid surface pitting and should generally deliver liquid at an average rate which does not exceed the rate at which the liquid can be absorbed into the powder by capillary action. This prevents the surface from becoming saturated and causing drip marks or local collapse. Spraying is usually terminated before full wetting occurs, so that the wetting of the still dry thicker parts of the moulding is completed by capillary action, drawing liquid from the adjacent wet parts. This allows the minimum quantity of liquid to be applied for full wetting, thus avoiding the risk of over-wetting which can cause the mixture to stick to the mould sides and reduce demoulding strengths. When the damp areas have spread throughout the mass, the mould is opened and the uncured product transferred (by vacuum lifting methods, for example) to conventional curing bays for hardening.

For large bores, a number of spray nozzles may be attached to the sides of delivery tubes 8 so the entire bore surface can be sprayed with little or no vertical oscillation of the tubes. A further refinement is to attach spray nozzles to the ends of suitably hollowed bore formers 6 so that spraying commences immediately the formers start being withdrawn. Generally it is difficult to deliver sufficient liquid for full wetting by this method unless the bore formers are withdrawn very slowly. However, the method can provide an initial coating of liquid and wetting can be completed by spray tubes 8 as previously described. Such progressive whole or partial wetting of the upper part of the bores while the dry parts below the spray nozzles are still covered by the bore formers, allows less cohesive dry powder mixtures to be used as these now do not have to support a full head of dry material. The technique can be useful for very tall products, although the fiber content needed for adequate strength of the finished product generally imparts sufficient strength to the dry compacted materials to resist collapse and generally such initial wetting is unnecessary. The self weight of the dry material in such cases can be resisted by a combination of arch action against the mould faces and the tensile support given by the reinforcement. This allows practically any height of material to be self-supporting when the bore formers are moved.

It is also possible to apply the liquid by means other than spraying. For example, the liquid can be made to emerge from the ends of suitably hollowed bore formers 6 while the latter are being withdrawn. The rate of bore former withdrawal, liquid flow and capillary absorption have to be carefully balanced to ensure even wetting and prevent progressive over wetting. This leads to slow wetting rates in production but the method is useful when core diameters are too small to accommodate the spray nozzles. It can be preferable to allow the liquid to emerge from slots in, or castillated ends of, the hollow bore formers, to reduce the incidence of blow holes on the bore surface as locked-in air tries to escape through the film of liquid on the bore surface. In this arrangement the liquid penetrates initially where it is in contact with the powder, allowing the air to escape through the intervening dry parts between the slots of castillations. The dry parts are then wetted by capillary action.

Numerous variations are possible within the same basic principles. For example, the plant may include equipment for inserting a reinforcing mat into the gaps between the mould sides and the bore formers. Bore formers may alternatively be upward withdrawing and spray tubes may enter from the top instead of at the base. Filling rates for the dry materials, vibration and aspects other than spraying operations are generally as described in British Patent No. 1,346,767.

Figure 1:
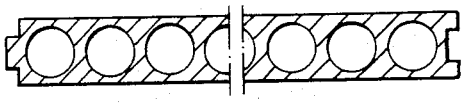
FIGS. 1,2,4,5 and 6 are cross-sectional elevations of typical construction products manufactured in accordance with the present invention.
Figure 4:
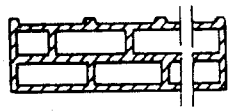

Numerous product designs are also possible. Apart from the typical basic shapes shown in FIGS. 1, 2 and 6, bores may be of any convenient shape and may occur in more than one row. Outer surfaces may also be shaped as shown in FIG. 4. Alternatively the product may have only one bore, giving for example, a box section or the pipe section shown in FIG. 5. Outer and inner surfaces can also be varied as, for example, in the bell-mouth ends for standard type junctions. Typical panels may be 50 mm thick, 1200 mm wide and 2400 mm long, with internal webs and flange thicknesses of around 3 mm. Pipes may be 2400 mm long and 600 mm in diameter. Floor sections (as in FIG. 6) may have 200 mm overall thickness, 5000 mm length and 1200 mm width. Web thicknesses could be around 300 for mesh reinforced panels or 15 mm for steel fiber reinforced units.

A wide range of liquid setting powders and fillers can be used and mixes include Portland cement, gypsum plaster, ground granulated blast furnace slag and pulverized fuel ash. Larger sized particles can be included, such as sand and/or lightweight aggregates such as expanded clay, perlite or vermiculite.

For such mixes, the aggregates do not generally exceed 3 mm but for larger diameter and more open reinforcement (such as steel mesh) it can be advantageous to increase aggregate sizes.

The powder constituents in the mix can have particle sizes varying from around 200 microns to within the colloidal range of under two microns.

The powdery packing round the reinforcement generates frictional resistance to reinforcement pull-out and this composite action usually provides more than adequate strength for satisfactory processing. Hence with most reinforced products in practice the powder characteristics themselves are generally not critical to process stability. In practice, the powder constituent is also generally the reactive (i.e. liquid setting) component and it has been found that all the usually commercially available types of cement and gypsum plaster can be processed satisfactorily.

The degree of compaction needed can only be determined empirically by, for example, increasing vibration energy and top pressure until reliable mouldings are produced. Ideally, for optimum end product strength and stability during manufacture, the particles should be brought together as close as possible before wetting. Side pressure can also be applied but this is usually not necessary. Normal concrete vibration equipment operating at 3000 cycles per minute can be adequate for many mixes. Vibration frequency can also be adjusted to optimize compaction rates, with higher frequencies usually being more effective for the smaller particle sizes. The degree of vibration (and hence compaction) also significantly affects the end product strength after curing and for commercially viable products made by the new process, the proximity of particles to each other should normally be at least as close as commercially acceptable products made by conventional wet methods. It has been found that the vibration needed to obtain such normally compacted products is generally more than adequate for processing stability, provided adequate support from reinforcement is available. For very widely spaced reinforcement, the degree of compaction becomes more critical as one approaches the unreinforced condition of co-pending Application No. 80000421.

Typical reinforcing fibers include standard commercially available glass or polypropylene fibers, steel wire, wood chips or flakes, chopped jute and sisal. Fiber lengths used are preferably in the 25 mm to 100 mm range. Typical reinforcing mats may be of fibrillated polypropylene, woven vegetable fiber, chopped glass strand mat or steel. Mats should be open textured to allow the powders to penetrate and compact around the individual strands. For structural reasons reinforcing fibers or mats should preferably be concentrated towards the outer faces of the product and typical glass fiber or polypropylene mat weights in partition panels, for example, may be around 60 to 100 gms. per $m^2$ of reinforcement in each face. In addition to main reinforcing fibers, it is often desirable to include a proportion of much shorter fibers in the matrix to improve impact resistance of the finished product and cohesiveness for early demoulding. Such matrix fibers may include wood flour, fine short chopped poypropylene monofilament or asbestos fiber. With very fine well dispersed fibers, additions of under 1% can be effective.

Reinforcing fibers may be oriented either parallel or perpendicular to the bores depending on the type of reinforcement used. Loose fibers tend to slew around into the horizontal position on striking the compacted powder/fiber already in the mould and orient horizontally and at right angles to the vertical bores. If the fibers are long in relation to the gaps between bore formers, most of the reinforcement may be trapped in the gap between the mould sides and the bore formers with very little reinforcement passing into the webs. For certain applications this concentration of reinforcement in the outer layers can be used to economic advantage. For example, if fiber length is made about 30 times gap width, less than 1% of fibers may pass through the barrier formed by the row of bore formers. This can be achieved, for example, with 100 mm long fibers and 3 mm gaps. The percentage of fibers passing into the webs increases as fiber length/gap width ratio decreases: at fiber lengths of around 15 times gap width about 10% pass through the bore former barrier and about 20% pass for fiber lengths of about 5 times gap width. Deliberate screening out of most of the reinforcing fibers from the web zone is a departure from the earlier method in British Patent No. 1,346,767 where the aim was to distribute reinforcing fibers throughout the matrix evenly to provide a support medium during wetting. In accordance with the present invention provided sufficient fine particles are included and sufficient compaction is applied as described earlier, web zones with appreciably less reinforcement can be made sufficiently stable for effective product manufacture. However, completely fiber-free webs (such as can be obtained by the mat reinforcement described later) can be vulnerable during manufacture and at least some form of fibrous additive, such as the short matrix fibers described earlier, should be included.

Reinforcement with preferential orientation parallel to the bores can be achieved by inserting appropriately oriented mesh or mat reinforcement in gaps between the mould sides and the bore formers. In this case the powder mixture can be fed down the gaps between bore formers and, on reaching the compacted material in the mould, is vibrated into the open textured mats. This presses the reinforcement against the mould faces giving the most effective location for optimum bending strength. This applies mainly to glass fiber or polypropylene mats, where corrosion is not a serious problem and hence the cover layer to the reinforcement can be small. For uncoated steel meshes however reinforcement has to be located in the mould so it is at least 12 mm from the surface of the finished product. If loose fibers are also included in the powder mix, these tend to orient horizontally in the webs and at right angles to the mats, giving the most effective location of web reinforcement for optimum shear strength. Generally for all types of reinforcement, the amount of reinforcement needed to impart adequate structural strength to the end product, is more than sufficient to support the dry materials effectively and help prevent collapse during bore former withdrawal. This applies particularly to fibrous reinforcement but quite open meshes can provide a substantial degree of support.

A further improvement is to locate continuous vertical reinforcing strands instead of mats at or near the mould sides prior to powder filling and include reasonably long (e.g. 50 to 100 mm) chopped reinforcing fibers in the powder mix. This gives the effect of a mat (as the chopped fibers slew round to orient at right angles to the continuous strands) but without incurring the cost of weaving into a mat. Furthermore, filling rates can be faster as the fixed horizontal strands in a mat tends to inhibit the downward compaction of the powders, whereas the loose chopped fibers can move freshly with the compacting motion.

Setting liquid is generally water, which is frequently heated to aid rapid penetration. It is also advantageous to preheat the powder to maximize the effect of the heated water. For some powders (particularly some types of pulverize fuel ash) suitable wetting agents should be added to ensure effective penetration. The time taken for complete powder wetting varies with the type of powder, degree of compaction and wall thickness, wetting time can be as low as 30 seconds. This compares very favorably with the method in British Patent No. 1,346,767, where 1200 mm high products may require 30 minutes for complete wetting.

The degree of dryness of the constituents for effective flow and compaction vary with fiber content, particle size and shape and mould intricacy. Limiting moisture contents can only be determined by trial and error but generally the drier the constituents the better. The moisture content in the powder/fiber mixture should certainly be well below that needed for the chemical reaction of setting. Typically, in the case of gypsum without coarse aggregate moisture contents of readily flowable constituents are under 1% of the dry materials, as against around 20% when just sufficiently dampened for immediate demoulding. In such products the latter water content is little more than is needed for the setting reaction. This compares with liquid contents of around 40% for saturated materials as used in the method disclosed in British Patent No. 1,346,767. For some mixtures, such as those containing high percentages of Portland cement, than 20% moisture content of demoulding may be inadequate for completing the full chemical reaction of hardening and additional moisture may have to be provided during curing. This can be provided, for example, by additional spraying after demoulding and curing in 100% humid conditions. For cementitious mixes containing a relatively high proportion of coarse aggregate fillers the proportion of water needed to just wet the mix in some cases is as low as 10% of the weight of the dry mix. With these latter mixes, excessive wetting, say, to 22% may well have a deleterious effect on mould separation before chemical cure. This problem of over-wetting is of lesser relevance in the case of gypsum products, in that such materials are much faster setting and it is normal to effect curing before demoulding.

Typical mixes for the manufacture of (for example) 36 mm thick panels with 28 mm diameter core holes spaced at 31.5 mm centers were as follows:

EXAMPLE 1

Matrix: 67% unretarded gypsum hemi-hydrate casting plaster ("C.B. Stucco" from British Gypsum Limited); 33% expanded clay aggregate approximately 1 mm to 2 mm diameter ( crushed "Leca" from Leca Limited); 0.2% polypropylene matrix support fiber, 2.5 denier ×5 mm long; intimately mixed and dispersed into the gypsum powder prior to mould filling.

Reinforcement: Two layers (one at each panel face) of 92 gm/m$^2$ jute scrim (i.e. open mesh or "hessian") from Low Brothers Limited inserted between the mould sides and core formers before filling.

EXAMPLE 2

Matrix Unretarded gypsum as Example 1 above but with no coarse aggregate or matrix fiber;

Transverse Reinforcement: 50 mm chopped strand E-glass fiber (from Fiberglass Limited) metered into the flow of matrix material by regulating the speed of the glass cutter to give 70 gm/m$^2$ (i.e. 35 gm/m$^2$ per side) of reinforcement, which orientates itself horizontally in the mould during filling; due to the screening effects of the bore formers described earlier, about 90% of these fibers are trapped in the outer layers between the mould sides and the central row of bore formers.

Longitudinal Reinforcement: 136 tex E-glass fiber yarn (from Marglass Limited) placed in evenly spaced vertical lines at 3.75 mm centers at each mould face before matrix filling to give approximately 36.3 gm/m$^2$ longitudinal reinforcement per side.

EXAMPLE 3

Matrix: 23% ground granulated blast furnace slag ("Cemsave" from Frodingham Cement Company Ltd); 4.5 ground gypsum; 1.5% ordinary Portland cement; 57% sintered pelletized pulverized fuel ash lightweight aggregate (from Lytag Limited) with particle sizes from 2.35 mm to dust; 14% pulverized fuel ash (standard waste product from coal fined powder stations supplied by Pozzalin Limited); 0.2% polypropylene matrix fiber as in Example 1.

Reinforcement: 160 gm/m$^2$ (i.e. 80 gm/m$^2$ per side) of 50 mm long chopped strand alkali resistant glass fiber ("Cemfill" from Fiberglass Limited) metered into the mix as for the transverse reinforcement in Example 2. (Note: in this formulation the granulated slag, gypsum, and Portland cement react together forming a substance known in the industry as a supersulphated cement, which is characterized by having a low alkali content and as such minimizes alkali attack on the glass fibers).

The apparatus for manufacturing all these Examples was similar to that shown in FIG. 3. Vibration characteristics were optimized to give maximum compaction without causing erratic fibers patterns or particle size segretation. Bore former withdrawal was aided by slightly loosening the mould sides and retightening prior to spraying. Spray heads were the smallest capacity available commercially and gave a very fine, mist-like atomization. The cement based formulation (Example 3) was demoulded immediately after spraying for approximately 80 seconds and allowing a further minute to allow the moisture to spread to all parts of the moulding. The damp but substantially uncured samples were then transferred to the curing racks. The gypsum based samples (Examples 1 and 2) were demoulded after two minutes spraying and a further 20 minutes in-moulding curing.

The reinforcement content of all the samples was sufficient to give ultimate flexural strengths of the composite above the strength of the matrix on its own. Tests on samples of Examples 1 to 3 indicated that the flexural and impact performance in all cases would be adequate for typical building application (such as partition panels and roof decking).

Figure 2:
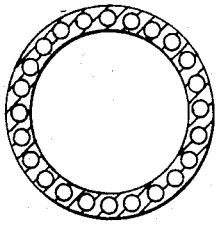
Figure 5:
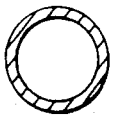
Figure 6:
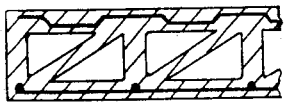

The cement based formulation in Example 3 would also be suitable for small and medium sized pipes (e.g. 100 to 300 mm diameter with 5 mm to 10 mm wall thickness) as shown in FIG. 5 or for larger diameter using the configuration shown in FIG. 2.

I claim:

1. A method of manufacturing construction products comprising the steps of feeding dry or substantially dry constituents including a liquid-setting powder and a reinforcement therefor into a molding zone, vibrating at least a part of said mold to effect compacting of the constituents in such molding zone to such a degree that said constituents will stand and be self-sustaining upon removal of an upstanding portion of the mold, removing at least a portion of the mold from contact from said compacted constituents, thereby exposing at least one upstanding surface of the compacted constituents, and applying to substantially the full extent of said surface a quantity of setting liquid, said quantity being sufficient to wet all of the compacted constituents in the molding zone so as to initiate a chemical setting reaction but not sufficient to completely saturate the compacted constituents and to cause the associated effect to structural collapse of the compacted constituents in the region of said exposed surface.

2. The method as claimed in claim 1 wherein the setting liquid is applied in a quantity which is only just sufficient to adequately wet the compacted constituents.

3. The method as claimed in claim 1 wherein the setting liquid is applied to the exposed surface by lightly spraying the liquid thereon.

4. The method as claimed in claim 1 wherein the product is a hollow cored product having at least one bore therein and the said exposed surface is the surface of the bore or each bore.

5. The method as claimed in claim 4 wherein the molding zone contains at least one substantially vertical bore former, the method comprising the step of withdrawing the bore former or formers from the molding zone after compacting said reinforced constituents and applying the setting liquid to the exposed bore surface or surfaces.

6. The method as claimed in claim 5 wherein the setting liquid is applied to the compacted constituents by seepage from the bore former or formers during withdrawal thereof.

7. The method as claimed in claim 5 wherein the rate of application of the setting liquid to the exposed surface is substantially equal to the rate at which the constituents can absorb such liquid by capillary action.

8. The method as claimed in claim 1 comprising removing the wetted compacted constituents from the molding zone before significant commencement of the chemical setting reaction.

9. The method as claimed in claim 8 comprising applying further setting fluid to the wetted compacted constituents after removal thereof from the molding zone.

10. The method as claimed in claim 5 comprising oscillating the feed of the constituents during feeding thereof into the molding zone to deliver such constituents alternately to opposite sides of the bore former or formers.

11. The method as claimed in claim 5 comprising vibrating the bore former or formers during feeding of the constituents into the molding zone to assist in compacting the constituents in the molding zone.

12. The method as claimed in claim 1 comprising applying pressure to the constituents in the molding zone to assist in compacting the constituents before exposing said surface and applying setting liquid thereto.

13. The method as claimed in claim 1 comprising heating one or both of the setting liquid and the liquid setting powder prior to the introduction thereof into the molding zone.

14. The method as claimed in claim 5 comprising temporarily loosening the walls of the mold while the bore former or formers is or are removed.

15. The method as claimed in claim 2 wherein the reinforcement for the liquid setting powder comprises fibers dispersed therein.

16. The construction product manufactured by the method of claim 2.

17. The product as claimed in claim 16 wherein the liquid set powder is reinforced with fibers of length in the range of 25 mm to 100 mm.

* * * * *